US006385871B1

(12) United States Patent
Quarfordt

(10) Patent No.: US 6,385,871 B1
(45) Date of Patent: May 14, 2002

(54) TOOTH ARRANGEMENT

(75) Inventor: Per Ulf Torgny Quarfordt, Karlskoga (SE)

(73) Assignee: Componenta Wear Parts AB, Kristinehamn (SE)

( * ) Notice: Subject to any disclaimer, the term of this patent is extended or adjusted under 35 U.S.C. 154(b) by 0 days.

(21) Appl. No.: 09/284,996

(22) PCT Filed: Nov. 15, 1996

(86) PCT No.: PCT/SE96/01481

§ 371 Date: Jun. 28, 1999

§ 102(e) Date: Jun. 28, 1999

(87) PCT Pub. No.: WO98/22664

PCT Pub. Date: May 28, 1998

(51) Int. Cl.[7] ..... E02F 9/28
(52) U.S. Cl. ..... 37/457; 37/455
(58) Field of Search ..... 37/455, 456, 457, 37/452, 453, 454

(56) References Cited

U.S. PATENT DOCUMENTS

| | | | | | |
|---|---|---|---|---|---|
| 2,716,822 | A | * | 9/1955 | Launder et al. | 37/457 |
| 2,798,403 | A | * | 7/1957 | Launder | 37/457 |
| 3,020,655 | A | * | 2/1962 | Launder | 37/457 |
| 3,468,210 | A | * | 9/1969 | Watts | 37/457 |
| 3,511,126 | A | * | 5/1970 | Watts | 37/457 |
| 3,520,224 | A | * | 7/1970 | Hensley et al. | 37/457 |
| 3,526,049 | A | * | 9/1970 | Nichols | 37/457 |
| 3,608,218 | A | * | 9/1971 | Sturgeon | 37/457 |
| 3,704,753 | A | * | 12/1972 | Hasforth et al. | 172/700 |
| 3,879,867 | A | * | 4/1975 | Ericson et al. | 37/457 |
| 4,077,729 | A | * | 3/1978 | Schwappach | 37/457 |
| 4,087,928 | A | * | 5/1978 | Mickus | 37/457 |
| 4,129,934 | A | * | 12/1978 | Gettman | 37/457 |
| 4,155,665 | A | * | 5/1979 | Kaarlela | 37/457 |
| 4,192,089 | A | * | 3/1980 | Schwappach | 37/457 |
| 4,516,340 | A | * | 5/1985 | Launder | 37/457 |
| 4,579,494 | A | * | 4/1986 | Bierwith | 37/457 |
| 5,394,629 | A | * | 3/1995 | Ruvang et al. | 37/455 |
| 5,469,648 | A | * | 11/1995 | Jones et al. | 37/457 |
| 5,561,925 | A | * | 10/1996 | Livesay | 37/457 |
| 5,617,655 | A | * | 4/1997 | Launder et al. | 37/455 |
| 5,765,301 | A | * | 6/1998 | Clendenning | 37/455 |
| 5,802,752 | A | * | 9/1998 | Quarfordt | 37/457 |
| 5,852,888 | A | * | 12/1998 | Cornelius | 37/457 |
| 5,918,391 | A | * | 7/1999 | Vinas Peya | 37/456 |
| 6,030,143 | A | * | 2/2000 | Kreitzberg | 37/455 |

* cited by examiner

*Primary Examiner*—Thomas B. Will
*Assistant Examiner*—Kristine Markovich
(74) *Attorney, Agent, or Firm*—Dennison, Scheiner & Schultz

(57) ABSTRACT

At their lower edge (6) excavators are provided with a tooth arrangement consisting of two parts (1 and 2), one part (2) being attached to the bucket (6) and the other part (1) being exchangeable. The two parts (1 and 2) are held together by means of a male and female relationship and a transverse aperture (3 and 25) with a locking body (4). When the exchangeable part (1) becomes worn it may start to become unstable. The object of the present invention is to eliminate this drawback and this is achieved in that the locking body (4) comprises two opposing flat surfaces, provided with one or more spacers (15–20) intended to restrict approach of the two surfaces towards each other.

3 Claims, 19 Drawing Sheets

5

TOOTH ARRANGEMENT

FIELD OF THE INVENTION

The present invention relates to a tooth arrangement used in excavators, for example, attached to the lower edge of the bucket.

DESCRIPTION OF RELATED ART

The tooth arrangement consists of two parts, one part being attached to the excavator bucket by welding or some other means, and constituting a male part. The other part of the tooth arrangement which is to constitute the part actually working the ground is the female part. The two parts are joined together and, when joined, produce a transverse aperture running through the arrangement. A locking body is then placed in said aperture. It has been found that when the exchangeable working part of the tooth arrangement becomes worn, it becomes unstable due to the properties of the transverse aperture and the locking body.

SUMMARY OF THE INVENTION

The object of the present invention is to eliminate said instability and this is achieved by using an aperture composed of an intermediate part and two identical end parts of the same width, the intermediate part, however, having greater width. A locking body is developed for this aperture, said body comprising two elongate parts located parallel with each other and having flat surfaces opposite each other. The width of the locking body is adapted along its length to fit said aperture. The two flat surfaces are provided with one or more outwardly directed spacers restricting the approach of the two flat surfaces. The space between the two flat surfaces is filled with a resilient material such as vulcanized rubber. It has been found advantageous to provide each of the two parts of the locking body with a spacer at each end and a spacer between them. In this way the approach of the surfaces towards each other is restricted, thereby eliminating the drawback of an unstable working part of the tooth arrangement.

It is advisable for the tip of the male part to have a cross section in the shape of a T, for the tip to be as stable as possible and for the innermost end of the female part to be designed to fit the tip of the male part so that the two parts assume a position in relation to each other which is as immovable as possible. Instability of the exchangeable part in relation to the fixed part is thus also reduced.

BRIEF DESCRIPTION OF THE DRAWINGS

The present invention will be described in more detail with reference to the accompanying drawings, in which.

DETAILED DESCRIPTION OF THE INVENTION

Figure 1:
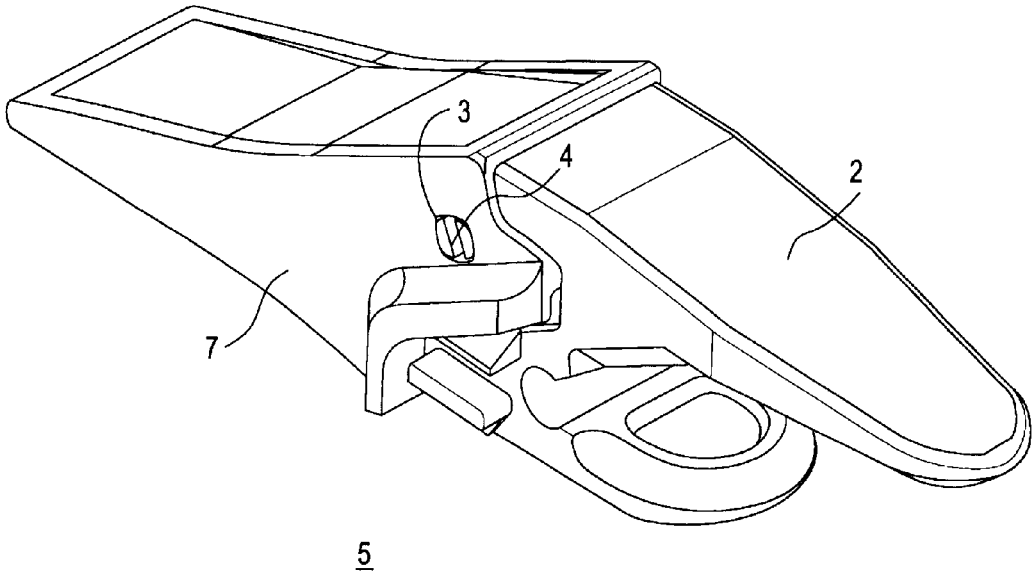
FIGS. 1–2 show a complete tooth arrangement viewed from two different directions, FIGS. 3–4 reveal the relationship between the locking body and the transverse aperture, certain parts of the exchangeable part having been removed.
Figure 2:
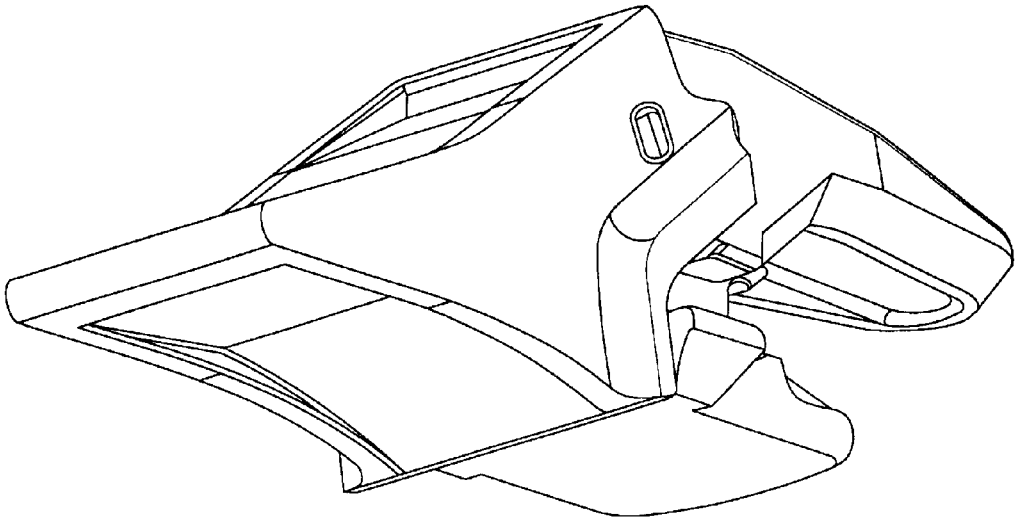
Figure 3:
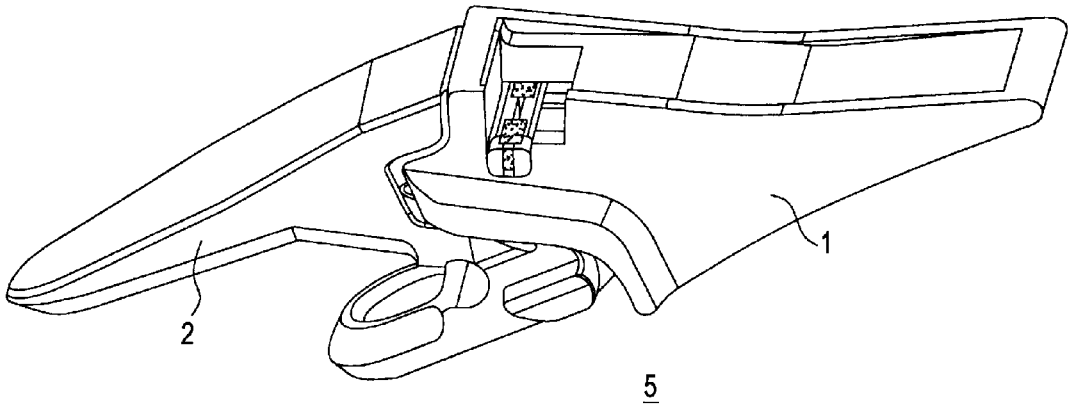
Figure 4:
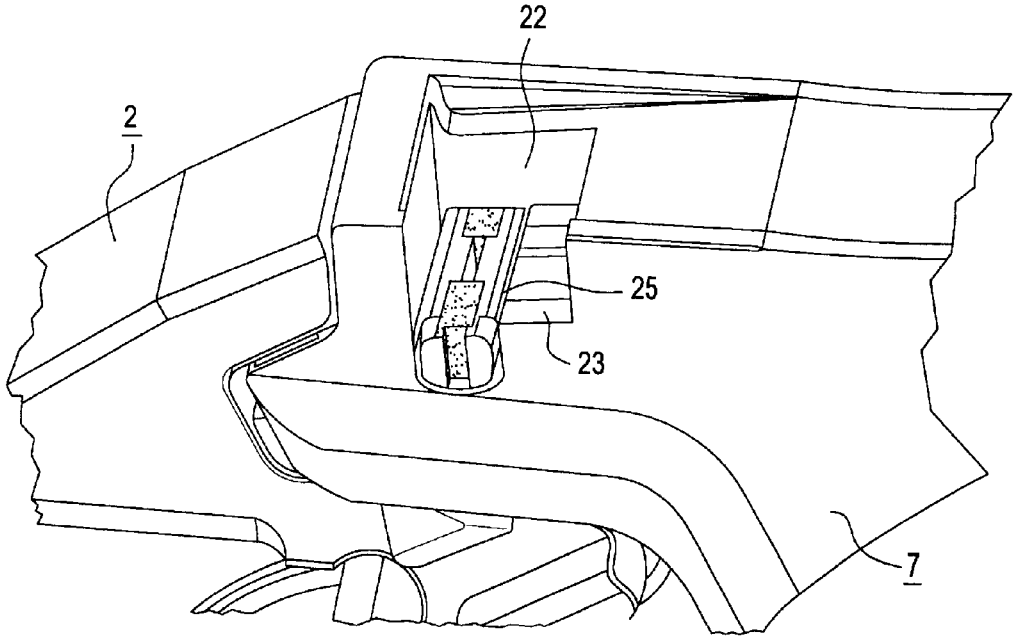
Figure 5:
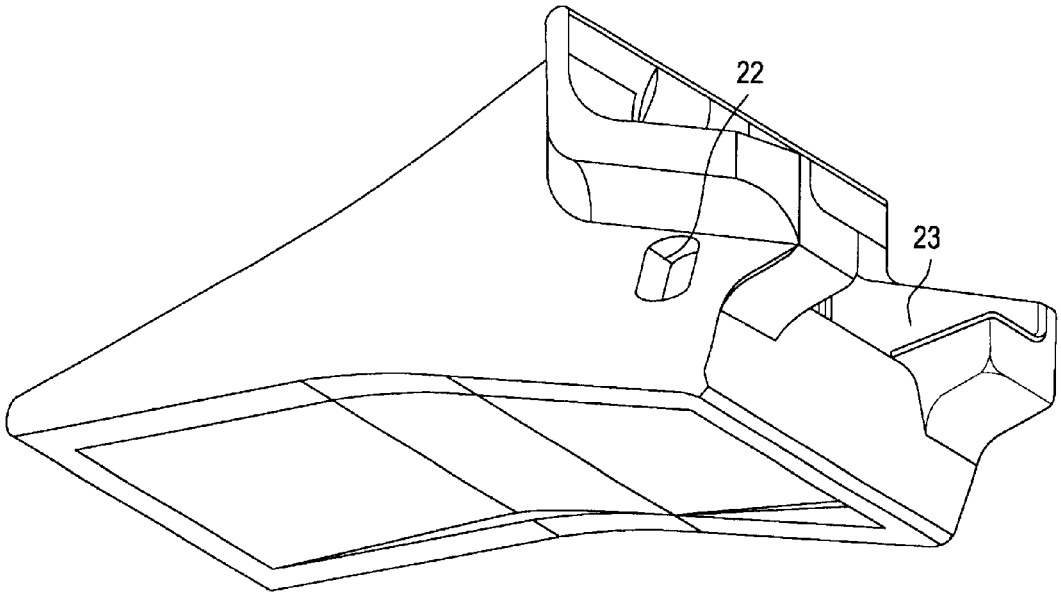
FIGS. 5–6 show the exchangeable part in the tooth arrangement.
Figure 6:
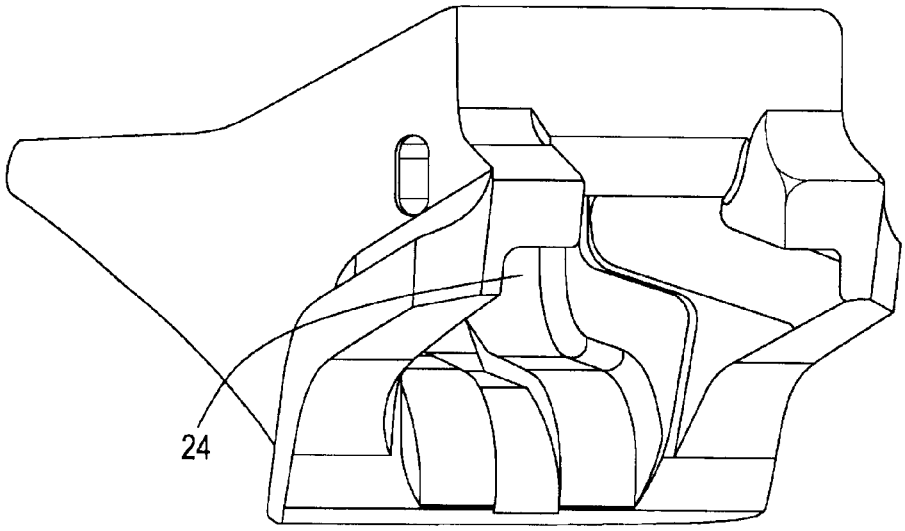
Figure 7:
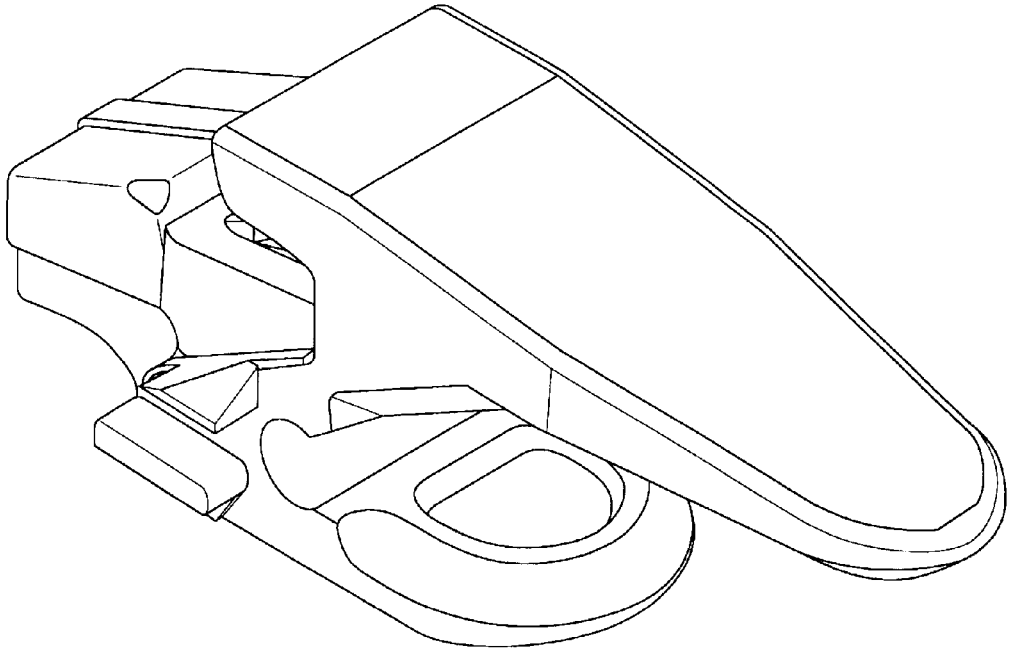
FIGS. 7–8 show the non-exchangeable part of the tooth arrangement.
Figure 8:
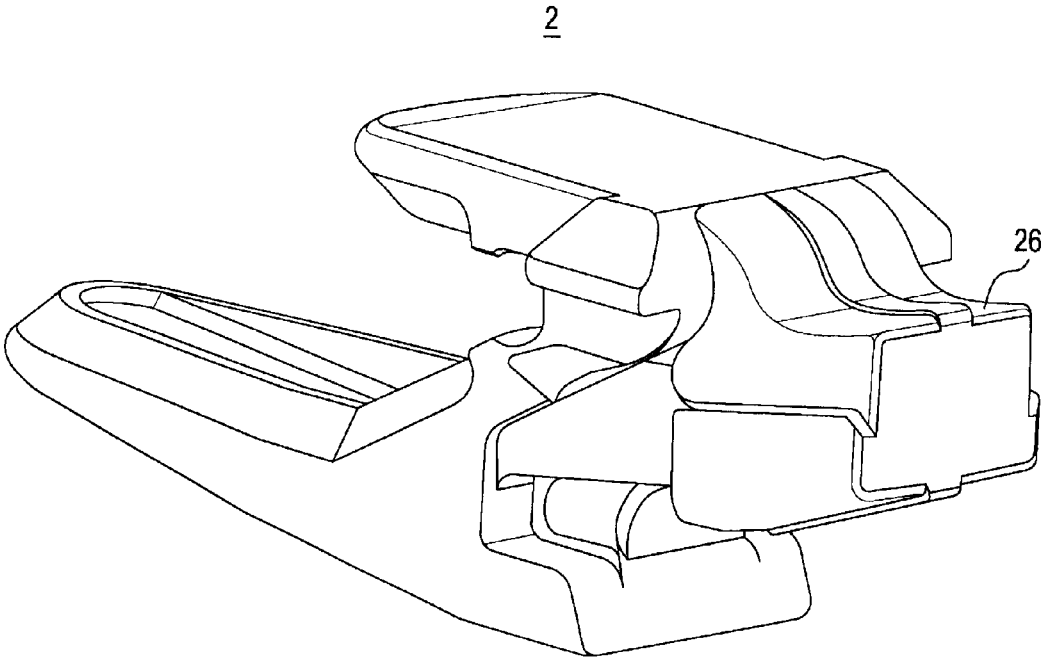

The drawings show a tooth arrangement 5 comprising a male part 2 intended to be welded to a cutter or the edge of an excavator bucket 6. Said male part is provided with a tip 26 for insertion into an aperture 24 in the female part 1. The female part 1 is a part for working the ground, which can be exchanged when it has become worn. The male and female parts form an aperture 3 situated on each side of the inserted tip 26. Between these two apertures 3 is an intermediate aperture. The two apertures 3 are identical and are arranged immediately opposite each other in two side walls of the female part. Between the two apertures the upper surface of the tip 26 of the male part 2 forms part of the intermediate aperture 25 and the remaining part of the intermediate aperture 25 is formed by the intermediate wall parts situated between the side walls of the female part 1. The two apertures 3 are narrower than the aperture 25. The apertures 3 are formed in the wall parts 22 and 23. A locking body 4 is placed in the aperture 3 and 25, this body comprising two metal parts 7 and 8, each having opposing flat surfaces. Each part 7 and 8 is provided with an intermediate part 9 and 10, respectively, and two end parts 11, 12 and 13, 14, respectively. The two flat surfaces are provided with spacers. Thus the part 7 has spacers 16 and 17 at its ends 11 and 12 and a spacer 15 at its intermediate part 9. As to part 8, it is provided with spacers 18 and 19 at its ends 13 and 14 and with a spacer 20 at its intermediate part 10. The space between the surfaces of the bar-like parts shown in FIG. 10 is filled with a resilient material which may consist of vulcanized rubber. The locking body 4 shown in FIG. 9 can thus be influenced in such a way that both flat surfaces of the parts 7 and 8 can move towards and away from each other. However, the parts 7 and 8 can never approach each other so far as to come into contact. The spacers ensure that, at maximum compression, the two flat surface will still be a certain distance from each other.

Figure 9:
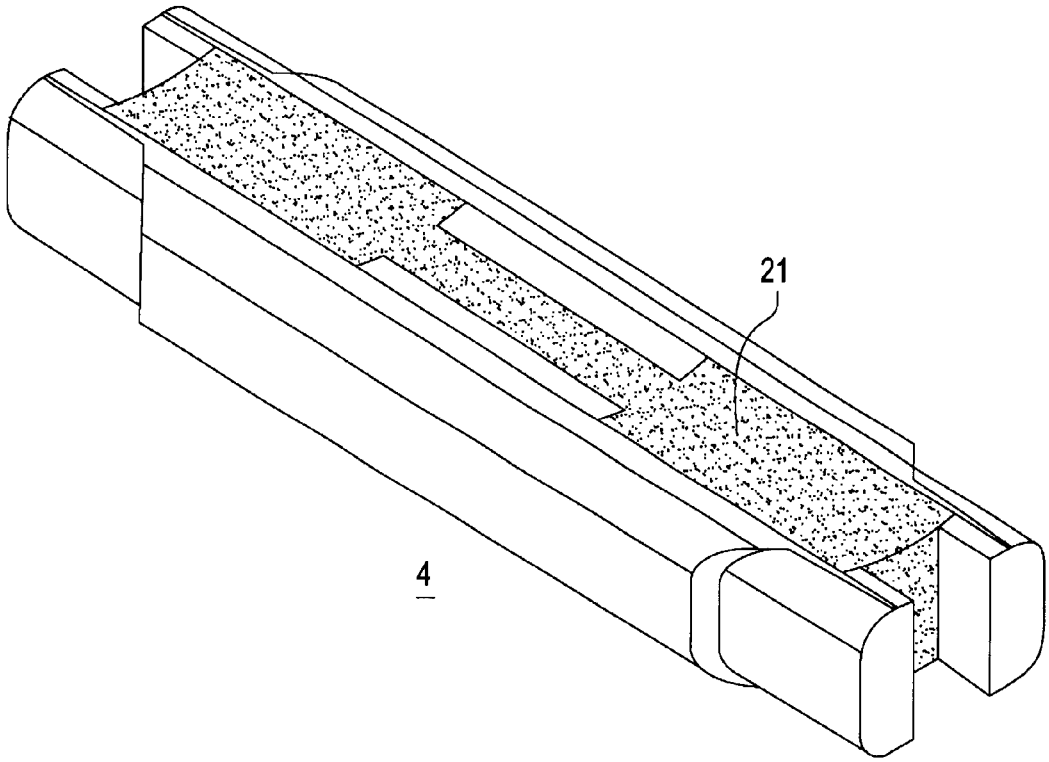
FIG. 9 shows the locking body with resilient material.
Figure 10:
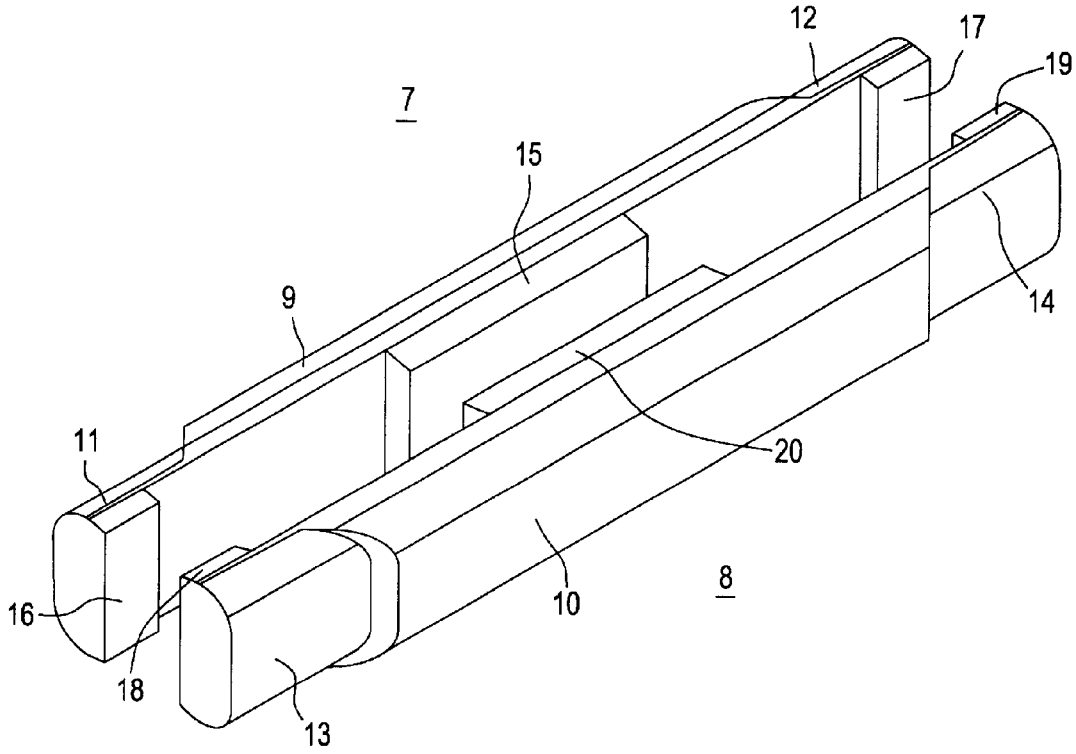
FIG. 10 shows the locking body without resilient material.
Figure 11:
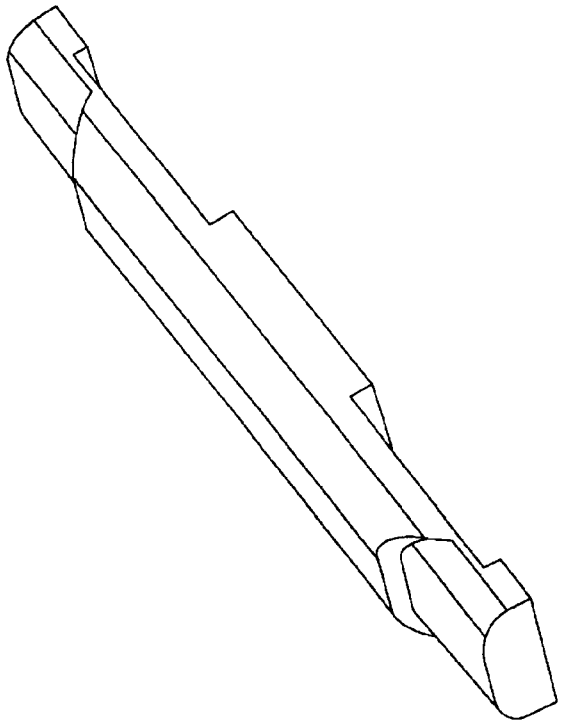
FIGS. 11–12 show the two fixed parts in the locking body.
Figure 12:
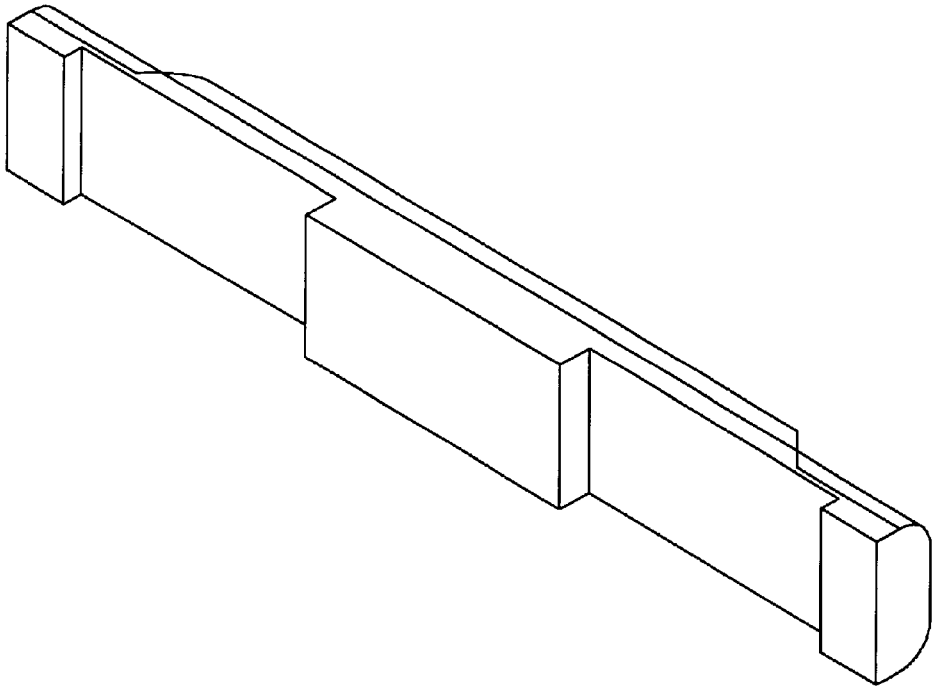
Figure 13:
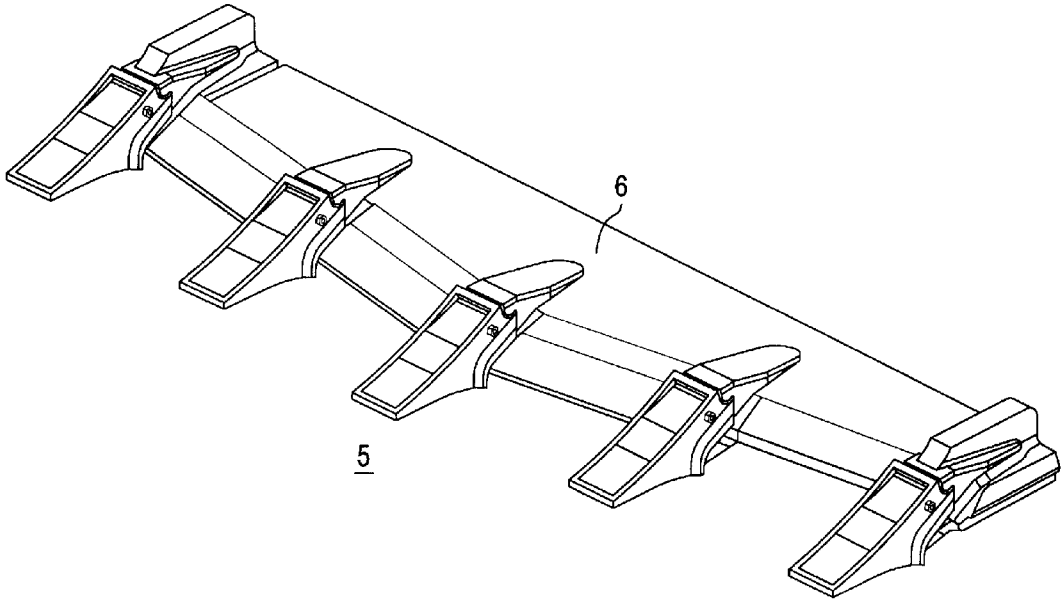
FIG. 13 shows a cutter provided with tooth arrangements in accordance with the present invention.
Figure 14:
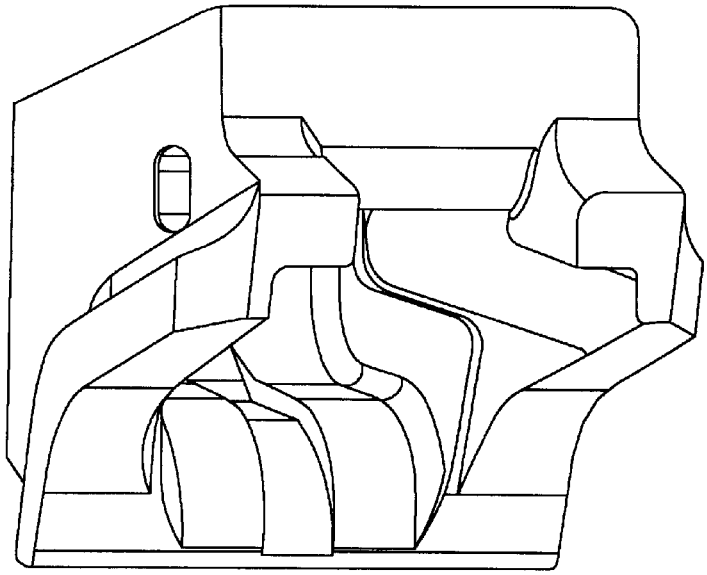
FIG. 14 shows the aperture in the female part.
Figure 15:
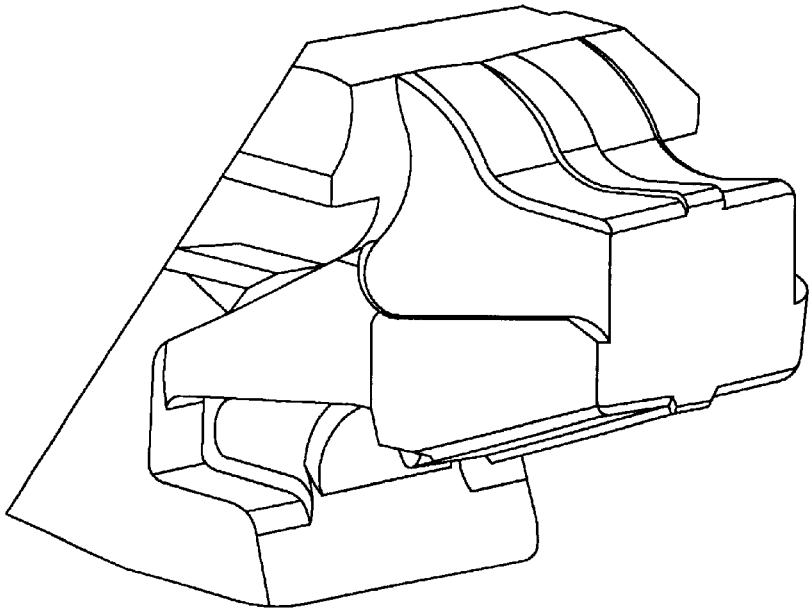
FIG. 15 shows the tip of the male part.
Figure 16:
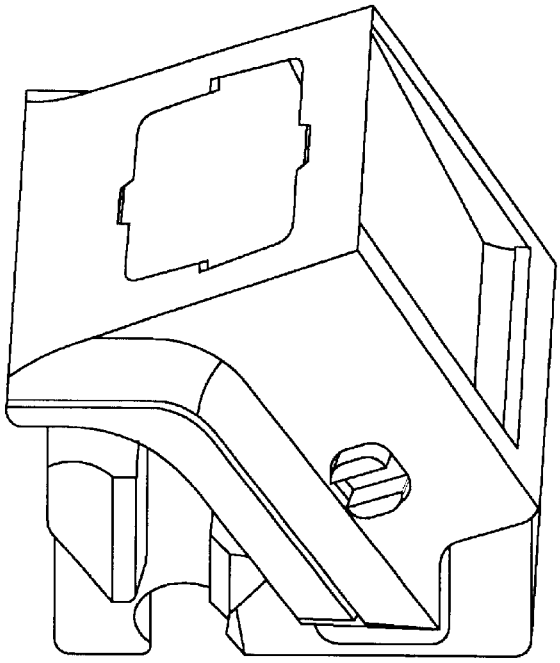
FIGS. 16–18 show the female and male parts joined together.
Figure 17:
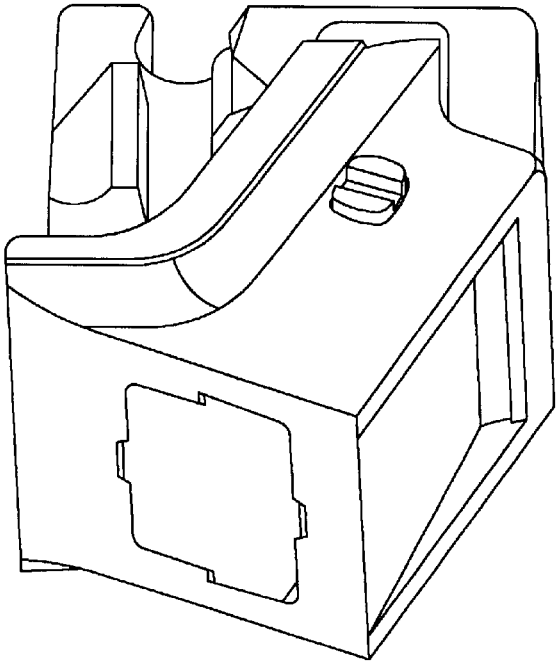
Figure 18:
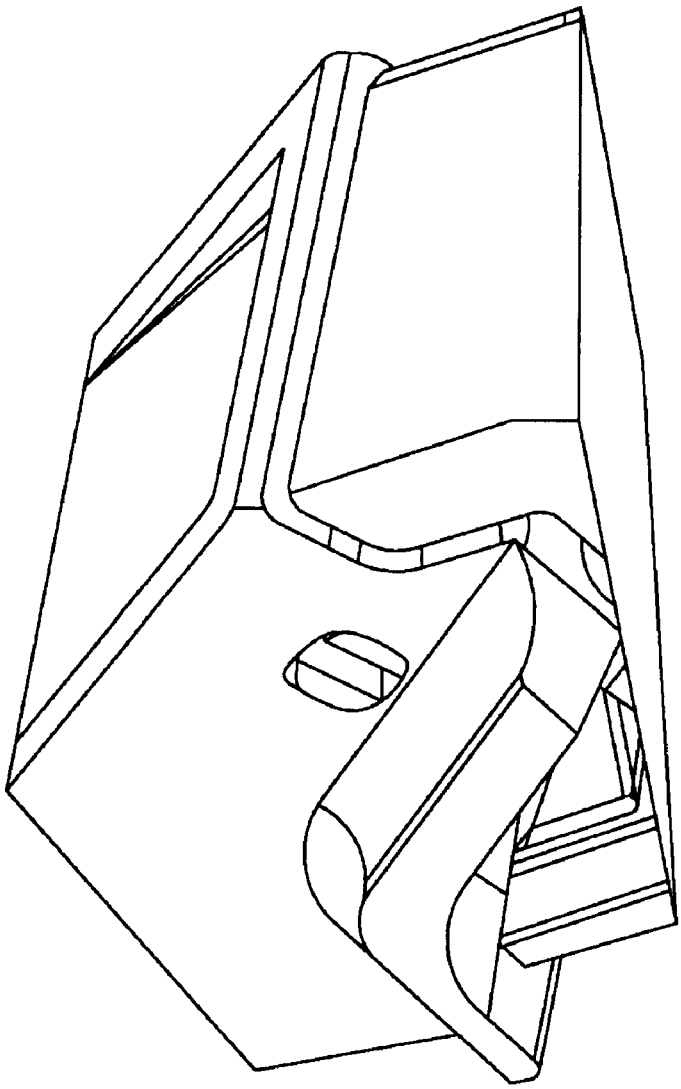

If the locking body 4 according to FIG. 9 is inserted in the aperture 3 and 25, the two parts 7 and 8 will be pressed together so that the locking body can be inserted through the aperture 3. When the locking body is fully inserted into the aperture 3 and 25 the two parts 7 and 8 will move apart so that the intermediate part of the locking body adjusted to the aperture 25 and the ends to the apertures 3.

When a tooth arrangement is in operation the parts 7 and 8 will of course approach each other. However, thanks to the spacers, the locking body will have such a width than any instability in the exchangeable part of the tooth is avoided.

Another contribution to avoiding instability in the exchangeable part may be that the tip 26 of the male part has a cross section in the form of a T and that the cross section has been made as solid as possible. This can be achieved, for instance, by making the upright of the T as long as possible and as wide as possible and suiting the innermost end 24 of the aperture of the female part to the tip 26 of the male part so that the walls of the female part at the tip of the male part abut the tip of the male part as tightly as possible.

Since the tip of the male part has a cross section in the form of a T and the innermost part of the aperture in the female part is shaped to fit this T-shaped cross section it is obvious that the transverse parts of the bar of the T will be clamped between two surfaces inside the innermost part of the female part and the actual tooth can be worn rather considerably from below without it falling off the male part.

FIGS. 14–18 show the actual core of the tooth arrangement, i.e. both attachment parts to a cutter and the tooth part itself have been removed. The actual core part can be used in any type of attachment part and together with any type of tooth part. The Figures thus show only the region of the tooth arrangement containing the tip of the male part and the aperture of the female part, and the transverse aperture with locking body.

It has already been explained that the male part 26 has a cross section in the form of a large T. The cross section thus has an upright and two outwardly directed cross bars which may be considered to form a yoke. The lower side of each cross bar is machined in such a way as to acquire the character of an inclined surface forming an angle with the centre line of the two bars in such a way that the surface has a shorter distance to said centre line at the upright and a longer distance at the outermost end of the bar. The interior of the female body is shaped correspondingly so that when male and female parts are joined these inclined surfaces will function as a locking device for the male and female body, thereby allowing increased wear on the actual tooth from below, without the male and female parts becoming separated from each other. These two inclined surfaces can of course be replaced with other types of surfaces filling the same function, i.e. preventing the male and female parts becoming separated from each other due to wear.

Figure 19:
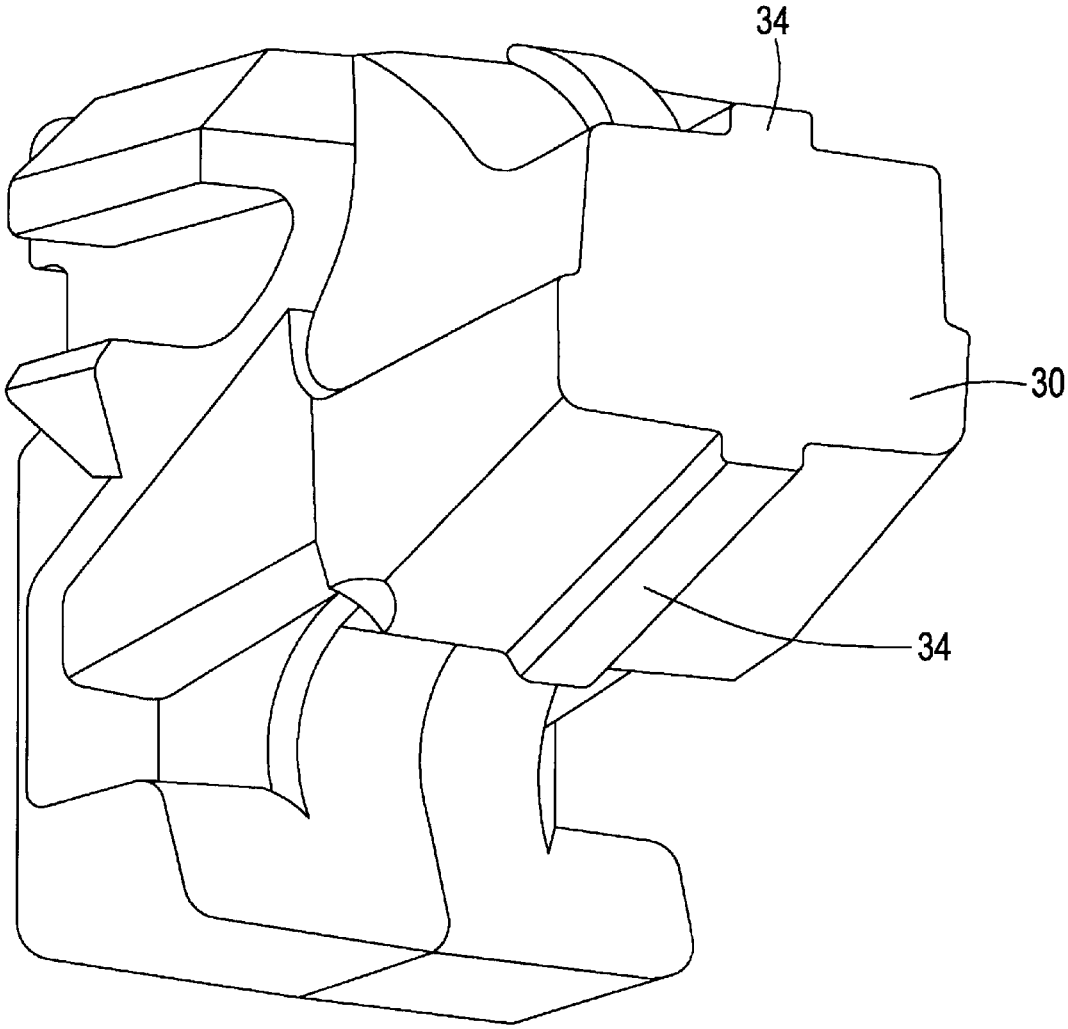
FIGS. 19 and 20 show an alternate embodiment of the male part.
Figure 20:
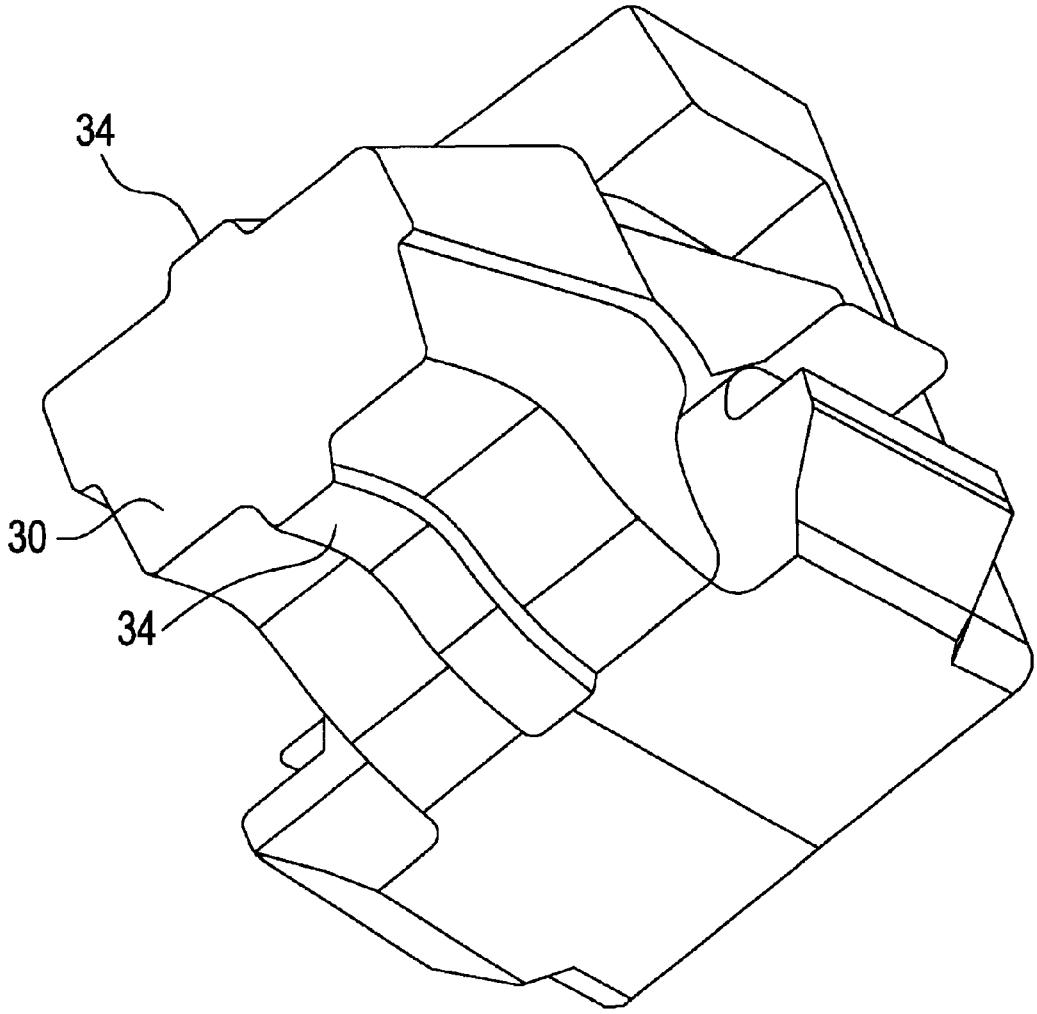
Figure 21:
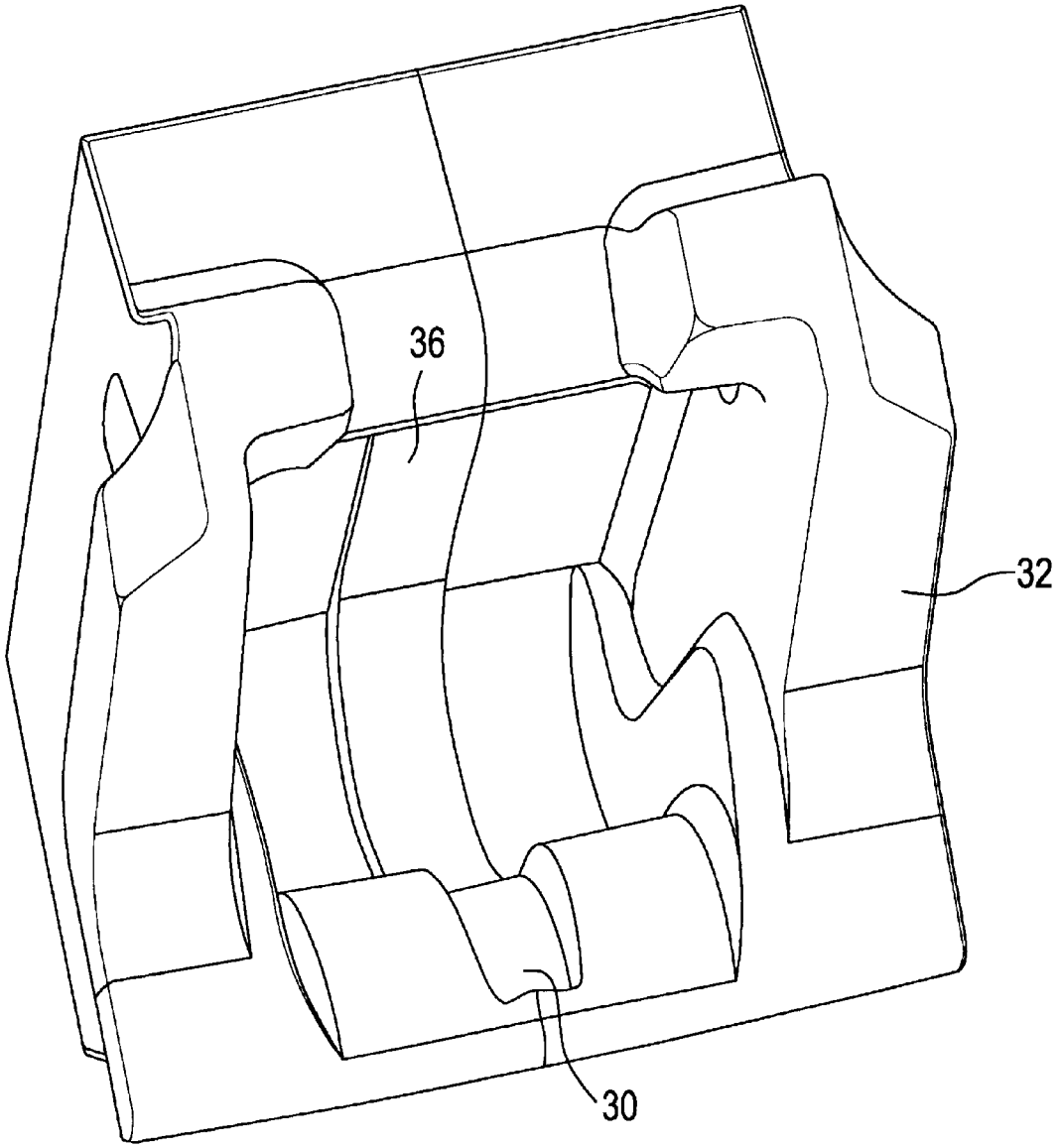
FIG. 21 shows an alternate embodiment of the female part for cooperating with the male part shown in FIGS. 19 and 20.

FIGS. 19–21 show an alternate embodiment of a male part 30 and a female part 32 wherein the male part 30 includes first and second longitudinal ridges 34 in opposite walls which ridges cooperate with grooves 36 in female part 32. This arrangement provides for a very secure connection between the male and female parts.

What is claimed is:

1. A tooth arrangement comprising a male part (2) and a female part (1) for attachment to a movable body (6), wherein the female part (1) is exchangeable, wherein the male part (2) is attached to the movable body, wherein the male part (2) and the female part (1) together form a transverse through-running aperture (3 and 25) having first and second outer parts and an intermediate part, where the two outer parts of the through-running aperture are arranged in the walls of the female part (1) and are coaxial and where the intermediate part (25) of the transverse aperture (3 and 25) is arranged in the male part (2) and is coaxial with said outer parts and has a constant cross section, wherein the male part (2) and the female part (1) are held together by a longitudinal locking body (4) placed in the through-running aperture, characterized in that the outer parts (3) of the through-running transverse aperture have the same dimension, which is less than the dimension of the intermediate aperture (25), in that the locking body (4) comprises two parallel and identical parts (7 and 8), each of said two parallel parts (7 and 8) having a flat surface, said flat surfaces being opposite each other and provided with first and second end spacers and an intermediate spacer between said first and second end spacers in that resilient material (21) having first and second end sections having a first width and a central section having a second width less than said first width is arranged between the opposite flat surfaces such that said intermediate spacers abut said central section of said resilient material, in that the ends of the locking body (4) have a dimension for cooperation and contact with the outer apertures (3), in that the intermediate part of the locking body has a dimension cooperating with and in contact with the intermediate part (25) of the aperture and in that the male part (2) has a tip in close contact with the walls of the female part.

2. A tooth arrangement as claimed in claim 1, characterized in that the tip (26) of the male part (2) has a cross section in the shape of a T and in that the inner wall of the female part (1) is designed to fit the cross section of the male part (2).

3. The tooth arrangement as claimed in claim 1, characterized in that the male part (2) has a top (26) having two opposite surfaces, each having a longitudinal ridge and in that two opposite surfaces of the hole (24) of female part (1) each have a groove collaborating with a corresponding ridge when the male part (2) is inserted in the female part (1) whereby in inserted condition a tottering is omitted between the male part and the female part owing to the existence of the grooves and ridges which also give the arrangement an optimal strength.

* * * * *